US009316109B2

(12) United States Patent
Foster et al.

(10) Patent No.: US 9,316,109 B2
(45) Date of Patent: Apr. 19, 2016

(54) TURBINE SHROUD ASSEMBLY AND METHOD OF FORMING

(75) Inventors: Gregory Thomas Foster, Greer, SC (US); Andres Jose Garcia-Crespo, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 735 days.

(21) Appl. No.: 13/443,273

(22) Filed: Apr. 10, 2012

(65) Prior Publication Data

US 2013/0266435 A1 Oct. 10, 2013

(51) Int. Cl.
*F01D 11/08* (2006.01)

(52) U.S. Cl.
CPC ..... *F01D 11/08* (2013.01); *F05D 2240/11* (2013.01); *F05D 2300/13* (2013.01); *F05D 2300/6033* (2013.01); *Y10T 29/4998* (2015.01)

(58) Field of Classification Search
CPC ..... F01D 11/00; F01D 11/003; F01D 25/10; F01D 25/14; F01D 25/24; F01D 25/243; F01D 25/246; F01D 25/26; F05D 2230/30; F05D 2230/31; F05D 2230/50; F05D 2230/51; F05D 2230/64; F05D 2240/10; F05D 2240/11; F05D 2240/40; F05D 2250/30; F05D 2250/31; F05D 2250/32; F05D 2250/37; F05D 2300/13; F05D 2300/603; F05D 2300/6033
USPC ..... 415/134, 139, 170.1, 173.1, 200, 197, 415/214.1
See application file for complete search history.

(56) References Cited

U.S. PATENT DOCUMENTS

| | | | | |
|---|---|---|---|---|
| 2,859,934 | A * | 11/1958 | Halford et al. | 415/115 |
| 4,013,376 | A * | 3/1977 | Bisson et al. | 415/117 |
| 4,247,248 | A * | 1/1981 | Chaplin et al. | 415/136 |
| 4,573,866 | A * | 3/1986 | Sandy et al. | 415/116 |
| 4,650,395 | A * | 3/1987 | Weidner | 415/116 |
| 4,759,687 | A * | 7/1988 | Miraucourt et al. | 415/127 |
| 5,080,557 | A | 1/1992 | Berger | |
| 5,137,421 | A * | 8/1992 | Hayton | 415/173.3 |
| 5,333,992 | A * | 8/1994 | Kane et al. | 415/138 |
| 5,553,999 | A * | 9/1996 | Proctor et al. | 415/173.1 |
| 6,048,170 | A * | 4/2000 | Dodd | 415/135 |
| 6,113,349 | A * | 9/2000 | Bagepalli et al. | 415/135 |
| 6,315,519 | B1 * | 11/2001 | Bagepalli et al. | 415/135 |
| 6,541,134 | B1 * | 4/2003 | Strangman et al. | 428/698 |
| 6,726,448 | B2 * | 4/2004 | Farrell et al. | 415/173.3 |
| 6,962,482 | B2 * | 11/2005 | Tanaka | 415/173.1 |
| 8,303,245 | B2 * | 11/2012 | Foster et al. | 415/134 |
| 2002/0094268 | A1 * | 7/2002 | Sugishita et al. | 415/139 |
| 2004/0141838 | A1 * | 7/2004 | Thompson | 415/209.3 |

(Continued)

FOREIGN PATENT DOCUMENTS

EP 2514925 A2 10/2012

OTHER PUBLICATIONS

European Search Report dated Jul. 13, 2015 for European Patent Application No. EP13162148.

*Primary Examiner* — Craig Kim
*Assistant Examiner* — Wayne A Lambert
(74) *Attorney, Agent, or Firm* — Dority & Manning, PA

(57) ABSTRACT

A turbine shroud assembly includes an inner shroud portion comprising a body portion having a first circumferential edge, and a discourager extending circumferentially past the first circumferential edge of the body portion, wherein the discourager is integrally formed with the inner shroud portion.

10 Claims, 7 Drawing Sheets

(56) References Cited

U.S. PATENT DOCUMENTS

| | | | | |
|---|---|---|---|---|
| 2006/0188736 | A1* | 8/2006 | Luthra et al. | 428/469 |
| 2007/0031258 | A1 | 2/2007 | Campbell et al. | |
| 2007/0212214 | A1* | 9/2007 | Paauwe | 415/170.1 |
| 2008/0025838 | A1* | 1/2008 | Marini et al. | 415/173.4 |
| 2008/0206046 | A1 | 8/2008 | Razzell et al. | |
| 2009/0010755 | A1 | 1/2009 | Keller et al. | |
| 2009/0053050 | A1* | 2/2009 | Bruce et al. | 415/200 |
| 2009/0087306 | A1* | 4/2009 | Tholen et al. | 415/173.1 |
| 2009/0148277 | A1* | 6/2009 | Tholen et al. | 415/173.1 |
| 2009/0220776 | A1* | 9/2009 | Meschter et al. | 428/335 |
| 2010/0247298 | A1* | 9/2010 | Nakamura et al. | 415/173.1 |
| 2011/0020113 | A1* | 1/2011 | Beeck | 415/174.2 |
| 2011/0085899 | A1* | 4/2011 | Foster et al. | 415/189 |
| 2011/0171011 | A1* | 7/2011 | Lutjen et al. | 415/173.5 |
| 2011/0182724 | A1* | 7/2011 | Koyabu et al. | 415/180 |
| 2011/0318171 | A1* | 12/2011 | Albers et al. | 415/173.1 |
| 2012/0082540 | A1* | 4/2012 | Dziech et al. | 415/173.1 |
| 2012/0107122 | A1* | 5/2012 | Albers et al. | 416/179 |

* cited by examiner

TURBINE SHROUD ASSEMBLY AND METHOD OF FORMING

BACKGROUND OF THE INVENTION

The subject matter disclosed herein relates to turbine systems, and more particularly to turbine shroud assemblies therein.

Turbine engines, and particularly gas turbine engines, include high temperature turbine sections that have rotating blades which seal radially against a set of high temperature material components, known as shrouds. The shrouds form an annulus cavity in which the rotating blades function. The shrouds require cooling, based on the high temperature environment experienced by the shrouds, thereby reducing the efficiency of the overall gas turbine system. Therefore, it is desirable to reduce the cooling flow to an inner shroud portion of the shroud, in order to increase turbine section performance. As a result, the inner shroud portion is often fabricated out of a high temperature material that is impervious to the turbine section temperatures. Despite the previous efforts, the flowing of the high temperature gas from the turbine section to an outer shroud portion still poses issues.

BRIEF DESCRIPTION OF THE INVENTION

According to one aspect of the invention, a turbine shroud assembly includes an inner shroud portion comprising a body portion having a first circumferential edge, and a discourager extending circumferentially past the first circumferential edge of the body portion, wherein the discourager is integrally formed with the inner shroud portion.

According to another aspect of the invention, a turbine assembly includes a first inner shroud portion comprising a discourager. Also included is a second inner shroud portion comprising a second inner shroud circumferential edge, wherein the discourager extends past the second inner shroud portion circumferential edge.

According to yet another aspect of the invention, a method of forming a turbine shroud assembly includes enveloping a discourager formed of a ceramic matrix composite material around a fixture having a first circumference. Also included is forming an inner shroud portion by enveloping a body portion circumferential edge of a body portion formed of a ceramic matrix composite material around a portion of the discourager, wherein a portion of the discourager extends circumferentially past the body portion circumferential edge of the body portion.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
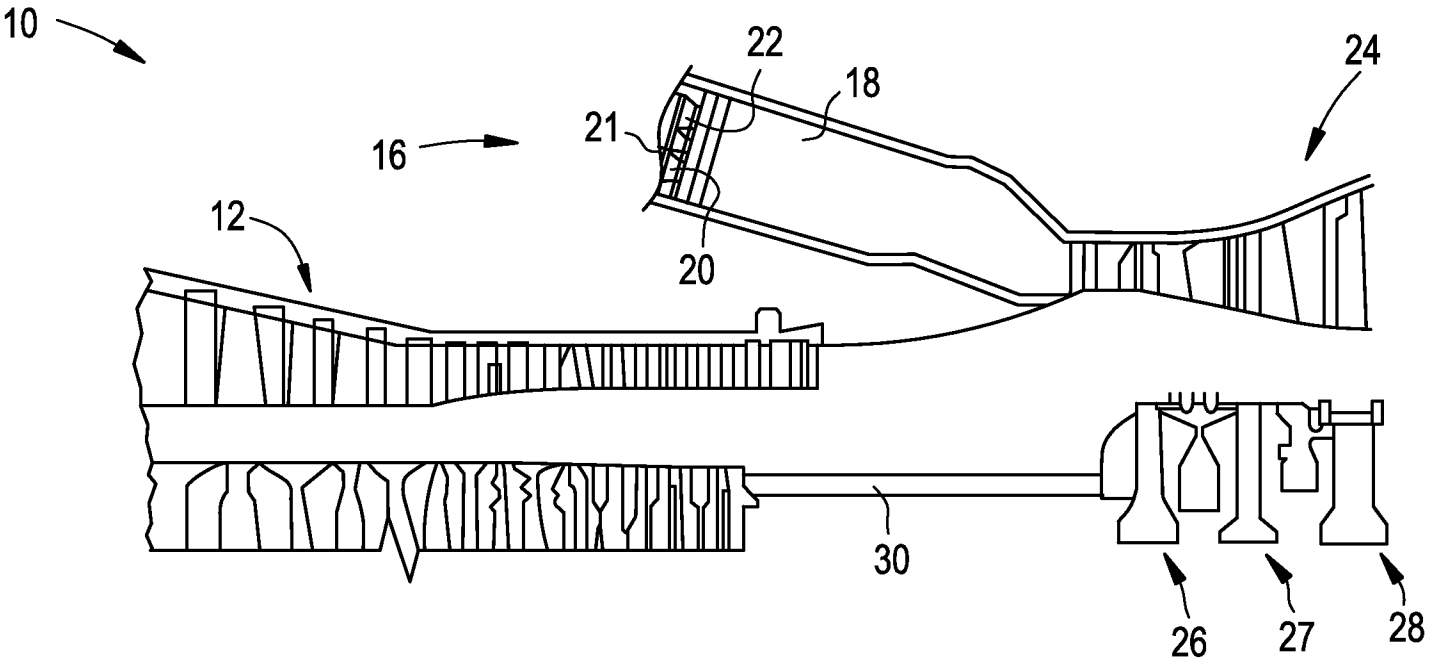
FIG. 1 is a partial, cross-sectional schematic view of a turbine system including a rotating assembly.

Referring to FIG. 1, a turbine system, shown in the form of a gas turbine engine, constructed in accordance with an exemplary embodiment of the present invention is indicated generally at 10. The turbine system 10 includes a compressor 12 and a plurality of combustor assemblies arranged in a can annular array, one of which is indicated at 14. As shown, the combustor assembly 14 includes an end cover assembly 16 that seals, and at least partially defines, a combustion chamber 18. A plurality of nozzles 20-22 are supported by the end cover assembly 16 and extend into the combustion chamber 18. The nozzles 20-22 receive fuel through a common fuel inlet (not shown) and compressed air from the compressor 12. The fuel and compressed air are passed into the combustion chamber 18 and ignited to form a high temperature, high pressure combustion product or air stream that is used to drive a turbine 24. The turbine 24 includes a plurality of rotating assemblies or stages 26-28 that are operationally connected to the compressor 12 through a compressor/turbine rotor 30.

In operation, air flows into the compressor 12 and is compressed into a high pressure gas. The high pressure gas is supplied to the combustor assembly 14 and mixed with fuel, for example process gas and/or synthetic gas (syngas), in the combustion chamber 18. The fuel/air or combustible mixture ignites to form a high pressure, high temperature combustion gas stream in excess of 2,500° F. (1,371° C.). Alternatively, the combustor assembly 14 can combust fuels that include, but are not limited to, natural gas and/or fuel oil. Irrespective of the combusted fuel, the combustor assembly 14 channels the combustion gas stream to the turbine 24 which converts thermal energy to mechanical, rotational energy.

Figure 2:
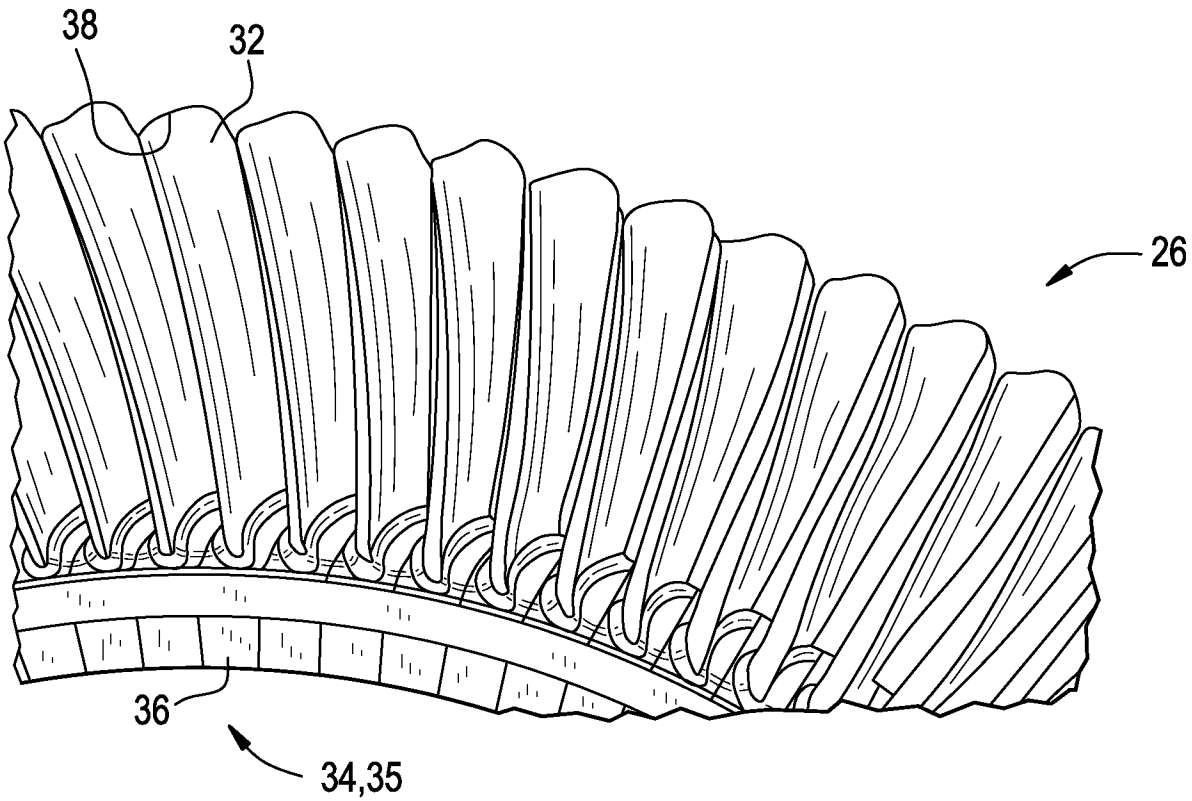
FIG. 2 is a partial perspective view of a rotating assembly including a plurality of rotating components.
Figure 3:
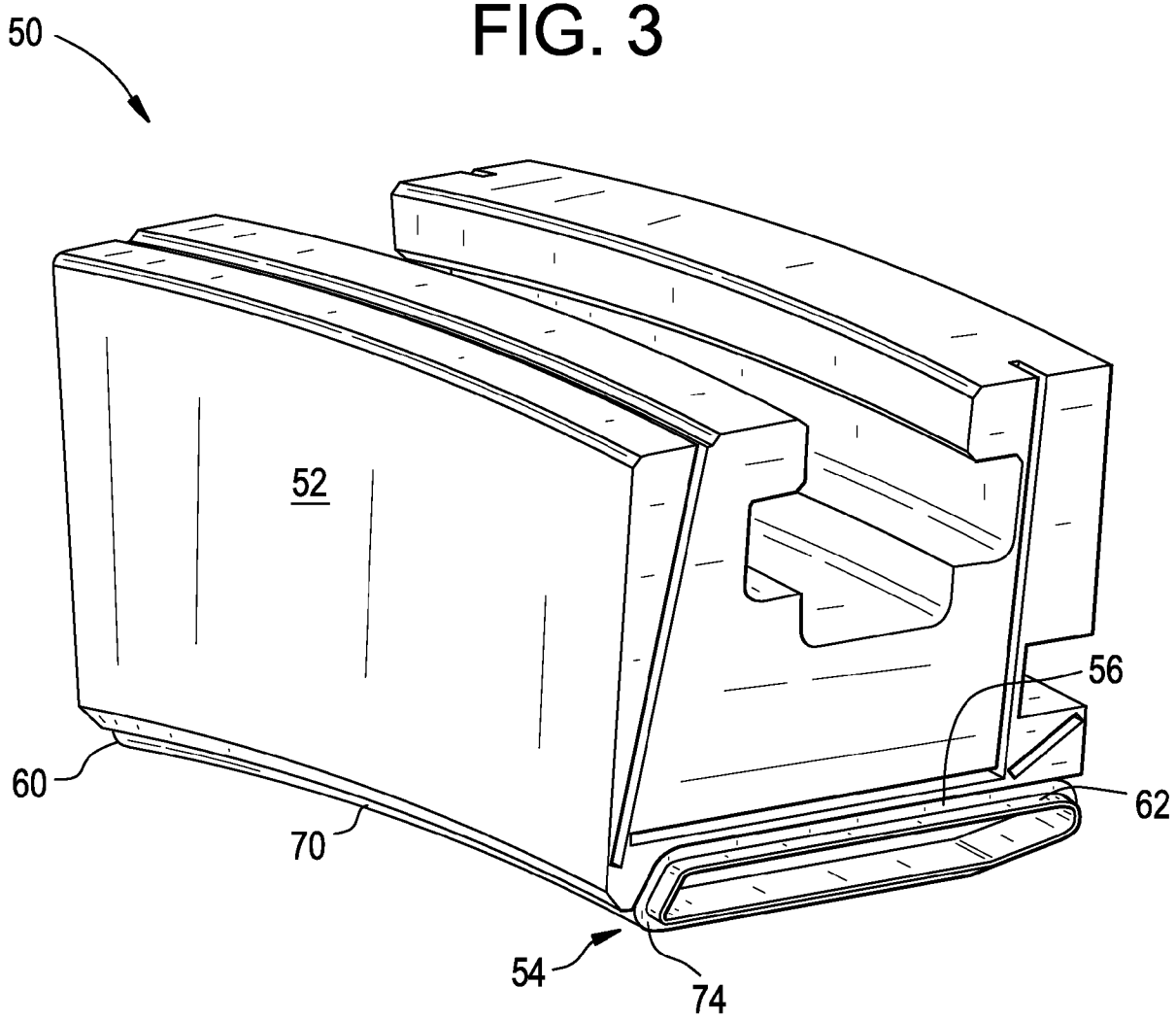
FIG. 3 is a perspective view of a turbine shroud assembly.

At this point, it should be understood that each rotating assembly or stage 26-28 is similarly formed, thus reference will be made to FIGS. 2 and 3 in describing stage 26 constructed in accordance with an exemplary embodiment of the present invention with an understanding that the remaining stages, i.e., stages 27 and 28, have corresponding structure. Also, it should be understood that the present invention could be employed in stages in the compressor 12 or other rotating assemblies that require high-temperature resistant surfaces. In any event, the stage 26 is shown to include a plurality of rotating members, such as an airfoil 32, which each extend radially outward from a central hub 34 having an axial centerline 35. The airfoil 32 is rotatable about the axial centerline 35 of the central hub 34 and includes a base portion 36 and a radially outer portion 38.

A turbine shroud assembly, illustrated generally as 50, covers a bucket or throat portion (not separately labeled) of the airfoil 32. The turbine shroud assembly 50 extends circumferentially about the stage 26 and is in close proximity to the radially outer portion 38. The turbine shroud assembly 50 creates an outer flow path boundary that reduces gas path air leakage over top portions (not separately labeled) of the stage 26, so as to increase stage efficiency and overall turbine performance.

The turbine shroud assembly 50 is illustrated in greater detail. The turbine shroud assembly 50 includes an outer shroud portion 52 and an inner shroud portion 54 operably coupled with each other, with the inner shroud portion 54 being closer in proximity to the airfoil 32 and the rotor 30, both previously described. The outer shroud portion 52 is typically formed of a metal material that provides effective sealing of secondary flow leakages that are commonly present at the outer shroud portion 52, and proximate an outer casing of the turbine 24. In some embodiments, the only a portion the outer shroud portion 52 may be formed of metal material. The inner shroud portion 54 is formed of a high heat tolerant material, such as a ceramic matrix composite (CMC) or a refractory alloy, for example. It is to be appreciated that the aforementioned materials are merely illustrative and various alternative materials having a high temperature tolerance may be suitable. The inner shroud portion 54 prevents or reduces the hot gas present in the turbine 24 from flowing to the outer shroud portion 52, based on the relatively low heat tolerance of the metal that the outer shroud portion 52 is formed of.

The outer shroud portion 52 includes a radially inner surface 56 and, as shown in the illustrated embodiment, the inner shroud portion 54 is disposed along the radially inner surface 56. The inner shroud portion 54 includes a discourager 62 that extends circumferentially beyond a body portion 70, and more specifically beyond a first body portion circumferential edge 74 of the body portion 70. Although shown as extending beyond the first body portion circumferential edge 74, it is to be understood that the discourager 62 may alternatively extend beyond a second body portion circumferential edge 60, and conceivably beyond both the first body portion circumferential edge 74 and the second body portion circumferential edge 60, in combination.

Figure 5:
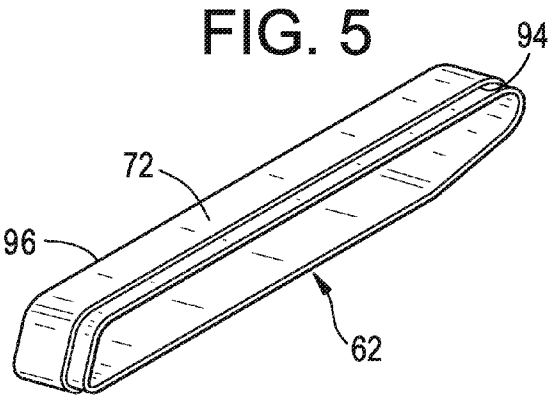
FIG. 5 is a perspective view of a spacer and the discourager portion of the inner shroud portion.
Figure 4:
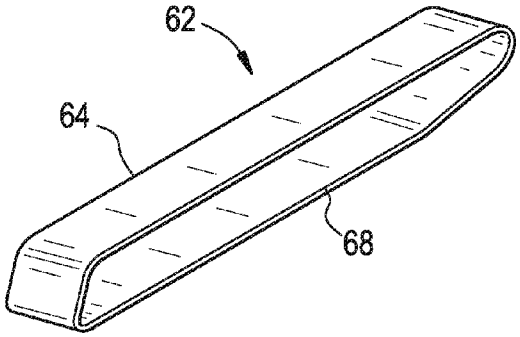
FIG. 4 is a perspective view of a discourager portion of an inner shroud portion of the turbine shroud assembly.
Figure 6:
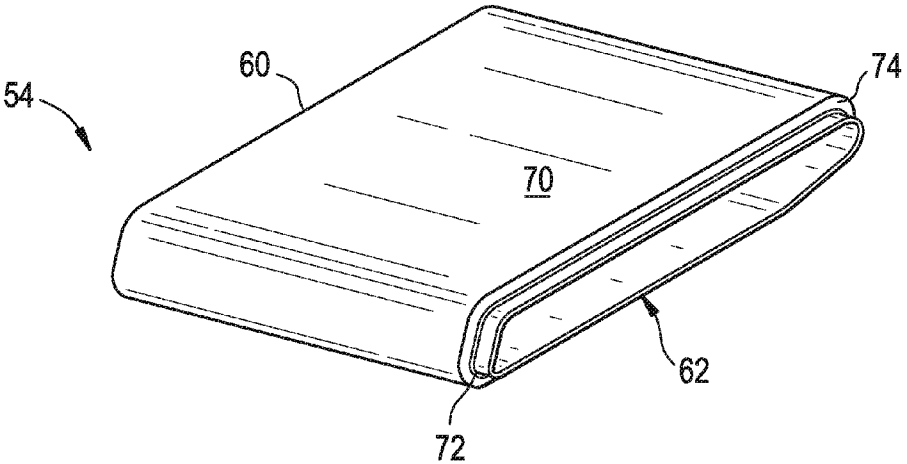
FIG. 6 is a perspective view of the inner shroud portion assembled with a body portion, the spacer and the discourager portion.

Referring to FIGS. 4-6, the inner shroud portion 52 is illustrated in greater detail. The discourager 62 is shown as having a relatively elliptical geometry, however, this is merely illustrative of the possible geometric configurations of the discourager 62. The discourager 62 includes a first edge 64 and a second edge 68 and is surroundably enclosed by the body portion 70 proximate the first edge 64. A spacer 72 having a first edge 94 and a second edge 96 may be disposed between the body portion 70 and the discourager 62.In particular, the first edge 94 of the spacer 72 is circumferentially aligned with the first body portion circumferential edge 74 of the body portion 70 and the second edge 96 of the spacer 72 circumferentially aligned with the first edge 64 of the discourager 62. The spacer 72 forms a gap between the discourager 62 and one or more adjacent objects, as described below. The second edge 68 of the discourager 62 extends beyond the first body portion circumferential edge 74 of the body portion 70. In the embodiment with the inner shroud portion 52 being comprised of CMC material, each of the discourager 62, the body portion 70 and the spacer 72 are formed of a plurality of CMC plies.

Figure 7:
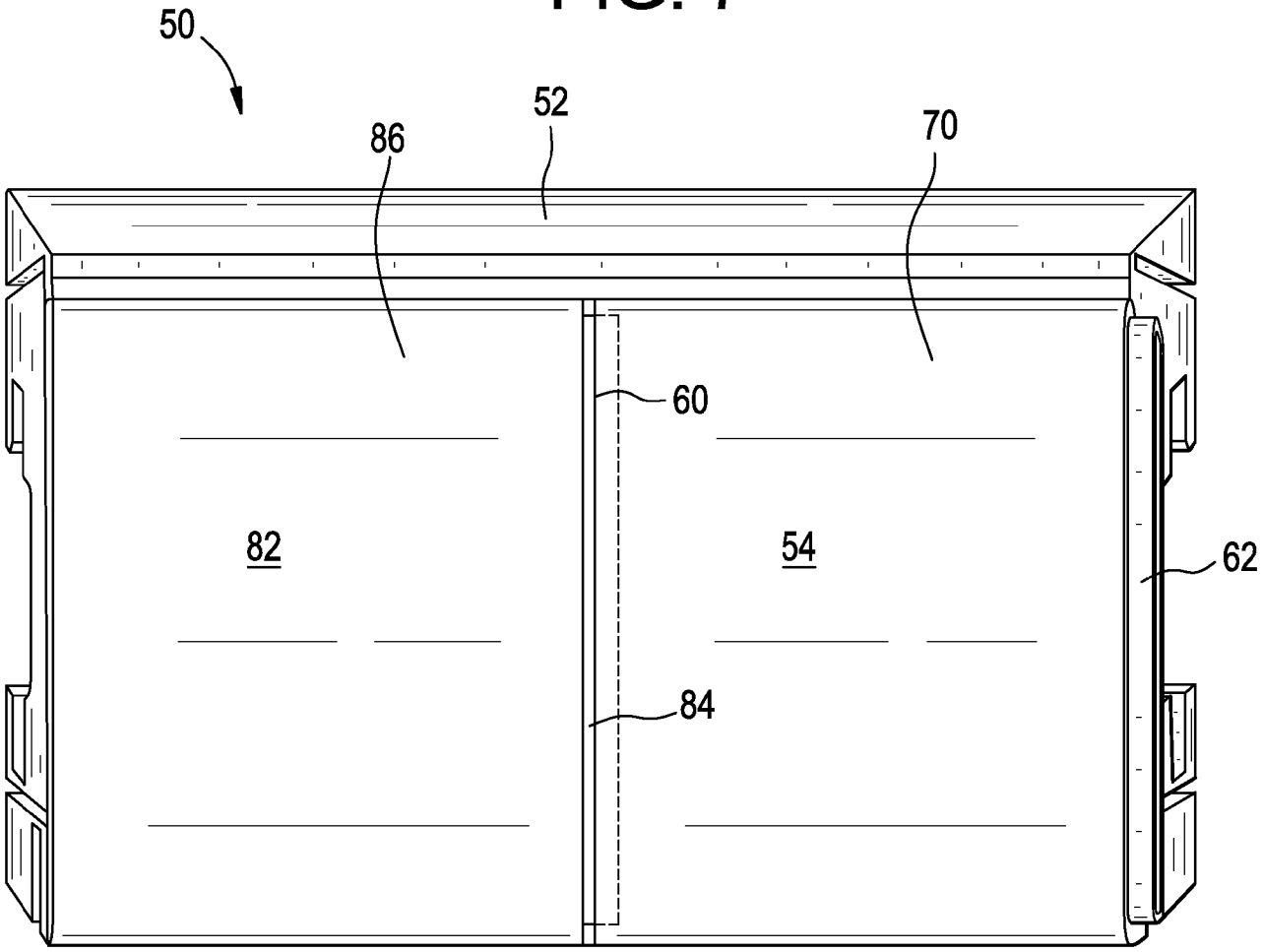
FIG. 7 is a bottom perspective view of the turbine shroud assembly having the inner shroud portion and an adjacent inner turbine shroud portion.

Referring to FIG. 7, the turbine shroud assembly 50 is illustrated in combination with an adjacent turbine shroud assembly, and more specifically an adjacent inner shroud portion 82. The adjacent inner turbine shroud portion 82 includes an adjacent discourager 84 that is similar in structure as discourager 62, and is similarly disposed, with respect to an adjacent body portion 86 that is similar in structure and disposition as that of body portion 70. The turbine shroud assembly 50, as illustrated, is formed of one or more outer shroud portions 52 that are operably coupled with a plurality of inner turbine shroud portions, such as inner shroud portion 54 and adjacent inner shroud portion 82. The inner shroud portion 54 and the adjacent inner shroud portion 82 coordinate to have a respective discourager 62 or 84 overlap slightly with the other inner shroud portion 54 or 82. The spacer 72 provides a gap between the discourager 62 and the adjacent inner turbine shroud portion 82. As shown in the illustrated embodiment, the discourager 84 extends beyond the second body portion circumferential edge 60 of the body portion 70. In doing so, the discourager 84 reduces hot gas present in the turbine 24 from permeating between the inner shroud portion 54 and the adjacent inner shroud portion 82 toward the outer shroud portion 52, which is sensitive to high temperature gases.

Figure 8:
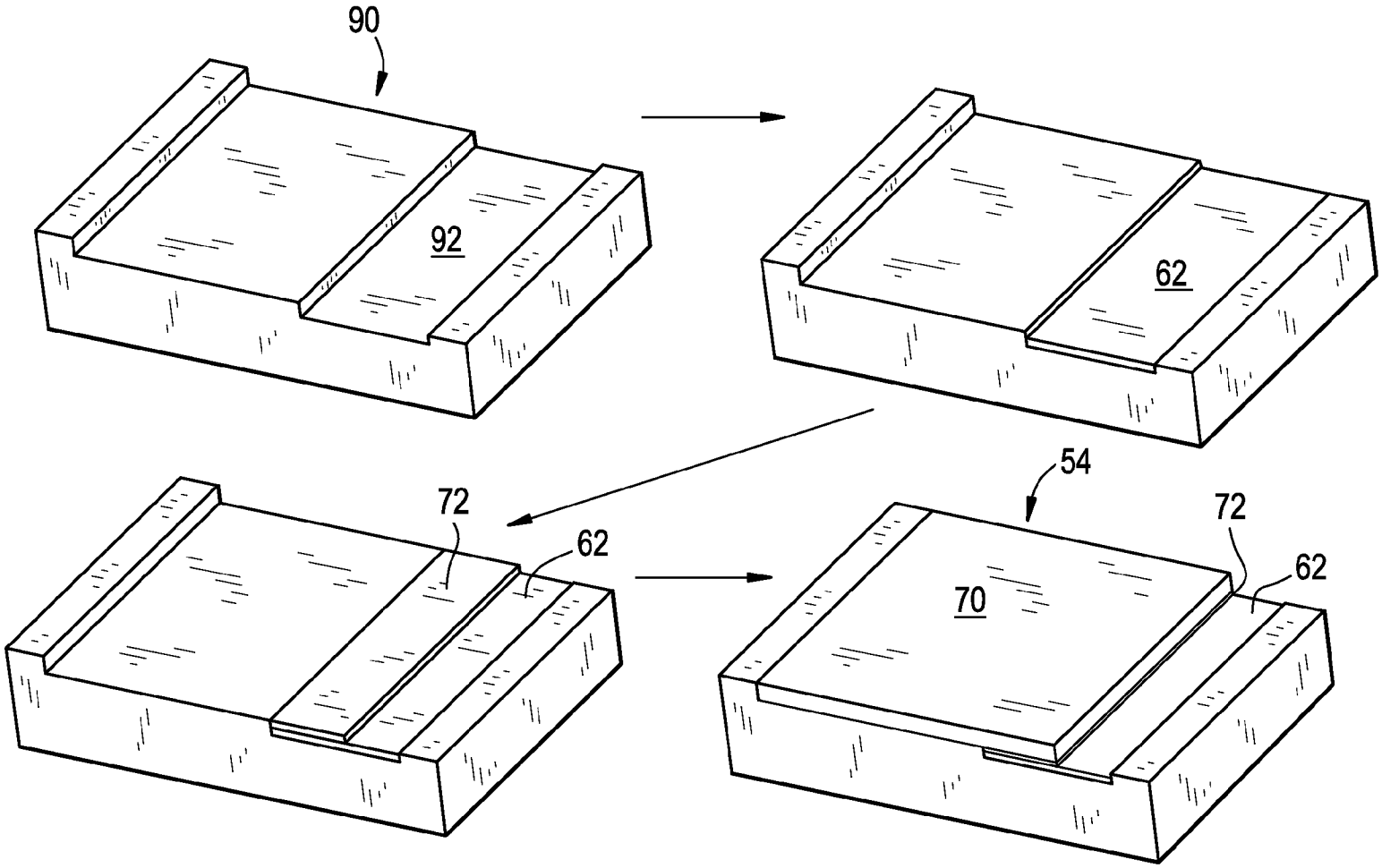
FIG. 8 is a schematic illustration of a method of forming the inner shroud portion.

Referring to FIG. 8, a method of forming the inner shroud portion 54 is generally illustrated. The inner shroud portion is schematically illustrated with relatively planar components for purposes of discussion, however, as described above, the components of the inner shroud portion 54 may be of various geometric configurations, including elliptical for example. A mandrel 90 or other machining fixture is pre-formed with dimensional and geometric configurations suitable for the application. An example of the unique geometric configuration is the recess 92 present in the mandrel. The discourager 62 is disposed within the recess 92 in a fitted manner. Surroundingly enclosing a portion of the discourager 62 is the body portion 70 of the inner shroud portion 54 and disposed therebetween may be the spacer 72, as described above. In the case of an inner shroud 54 comprised of CMC material, the illustrated components are formed by laying a plurality of plies for each component on illustrated portions of the mandrel 90 and wrapping the plies around the mandrel 90. As shown, wrapping the plies of the discourager 62 forms a shiplap on the mandrel 90, with the spacer plies being laid on top of the discourager section to impose a gap to account for tolerances and part mismatch at the point of final assembly. Finally, the plies forming the body portion 70 of the inner shroud 54 are added.

Figure 9:
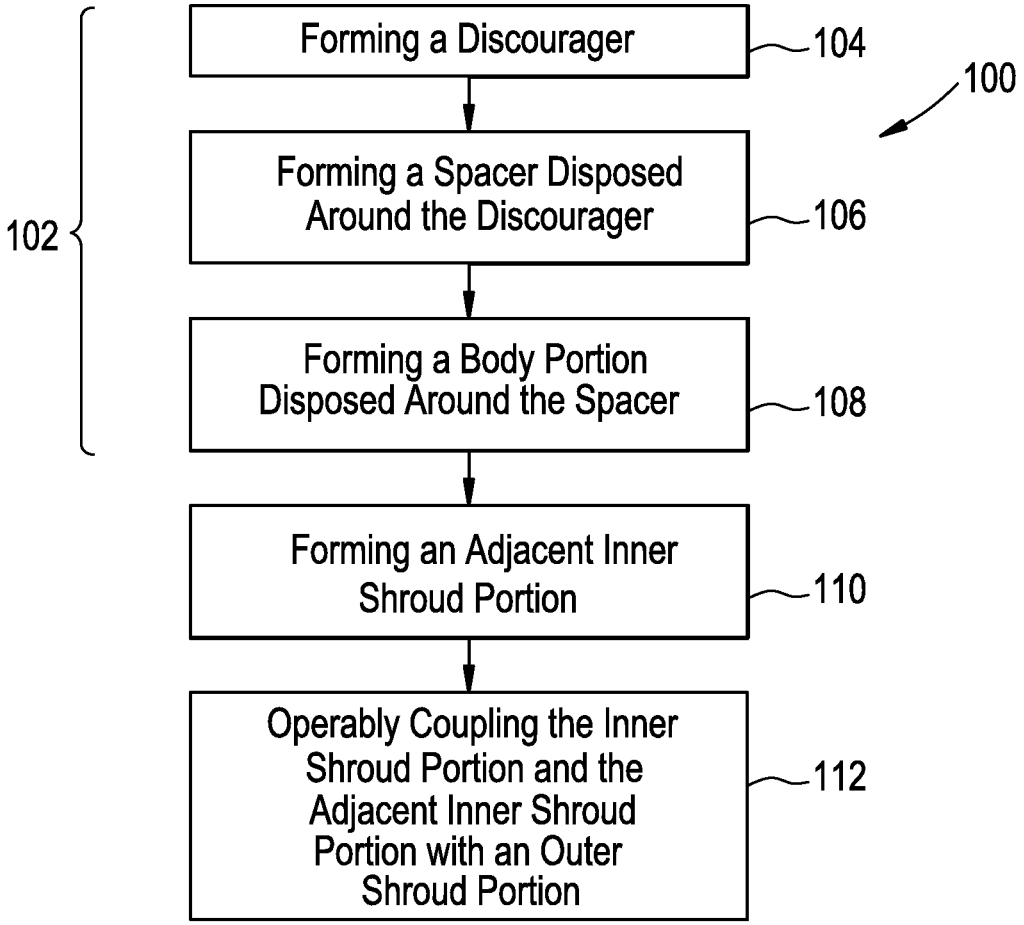
FIG. 9 is a flow diagram generally illustrating a method of forming the turbine shroud assembly.

Referring to FIG. 9, a method of forming a turbine shroud assembly is shown generally as 100 in the illustrated flow diagram. The method 100 includes forming the inner shroud portion 102, which comprises wrapping a plurality of discourager plies 104 to form a shiplap region, wrapping a plurality of spacer plies 106 around the discourager plies, and wrapping a plurality of body portion plies 108 around the spacer plies, thereby forming the CMC inner shroud. The method 100 also includes forming an adjacent inner shroud portion 110 in a manner similar to that of forming the inner shroud portion 102. Subsequent to formation of the inner shroud portion and the adjacent inner shroud portion, the method 100 includes disposing the inner shroud portion and the adjacent inner shroud portion in close proximity and operably coupling 112 the inner shroud portion and the adjacent inner shroud portion with the outer shroud portion. The inner shroud portion and the adjacent inner shroud portion are positioned such that the discourager of one inner shroud portion overlaps with at least a portion of the other inner shroud portion in a manner that prevents or reduces the hot gas present in the turbine from propagating to the outer shroud portion, which is sensitive to high temperature gases.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine shroud assembly, comprising:

a first inner shroud portion comprising:

a first body portion having a first edge and a second edge;

a first discourager having a first edge and a second edge, wherein the second edge of the first discourager extends circumferentially past the first edge of the first body portion and the second edge of the first body portion extends circumferentially past the first edge of the first discourager;

a first spacer positioned between the first discourager and the first body portion, the first spacer having a first edge circumferentially aligned with the first edge of the first body portion and a second edge circumferentially aligned with the first edge of the first discourager; and a second inner shroud portion adjacent to the first inner shroud portion, the second inner shroud portion comprising:

a second body portion having a first edge and a second edge;

a second discourager haying a first edge and a second edge, wherein the second edge of the second discourager extends circumferentially past the first edge of the second body portion and the second edge of the second body portion extends circumferentially past the first edge of the second discourager; and a second spacer positioned between the second discourager and the second body portion, the second spacer having a first edge circumferentially aligned with the first edge of the second body portion and a second edge circumferentially aligned with the first edge of the second discourager;

wherein the second edge of the first discourager extends circumferentially past the second edge of the second body portion, thereby defining a gap between a portion of the first discourager and a portion of the second body portion.

2. The turbine shroud assembly of claim 1, wherein the first inner shroud portion and the second inner shroud portion are formed of a material comprising a ceramic matrix composite.

3. The turbine shroud assembly of claim 1, wherein the first inner shroud portion and the second inner shroud portion are formed of a material comprising a refractory alloy.

4. The turbine shroud assembly of claim 1, further comprising at least one outer shroud portion, wherein at least a portion of the at least one outer shroud portion is formed of a metal.

5. A turbine assembly, comprising:

a compressor;

a combustion section; and a turbine comprising:

a first inner shroud portion comprising:

a first body portion having a first edge and a second edge;

a first discourager having a first edge and a second edge, wherein the second edge of the first discourager extends circumferentially past the first edge of the first body portion and the second edge of the first body portion extends circumferentially past the first edge of the first discourager;

a first spacer positioned between the first discourager and the first body portion, the first spacer having a first edge circumferentially aligned with the first edge of the first body portion and a second edge circumferentially aligned with the first edge of the first discourager;

a second inner shroud portion adjacent to the first inner shroud portion, the second inner shroud portion comprising:

a second body portion having a first edge and a second edge;

a second discourager having a first edge and a second edge, wherein the second edge of the second discourager extends circumferentially past the first edge of the second body portion and the second edge of the second body portion extends circumferentially past the first edge of the second discourager; and a second spacer positioned between the second discourager and the second body portion, the second spacer having a first edge circumferentially aligned with the first edge of the second body portion and a second edge circumferentially aligned with the first edge of the second discourager;

wherein the second edge of the first discourager extends circumferentially past the second edge of the second body portion, thereby defining a gap between a portion of the first discourager and a portion of the second body portion.

6. The turbine assembly of claim 5, wherein the first inner shroud portion and the second inner shroud portion are formed of a material comprising a ceramic matrix composite.

7. The turbine assembly of claim 5, wherein the first inner shroud portion and the second inner shroud portion are formed of a material comprising a refractory alloy.

8. The turbine assembly of claim 5, further comprising at least one outer shroud portion, wherein at least a portion of the at least one outer shroud portion is formed of a metal.

9. A method of forming a turbine shroud assembly, comprising:

forming a first inner shroud portion, wherein forming the first inner shroud portion comprises:

enveloping a first discourager around a fixture, the first discourager having a first edge and a second edge;

enveloping a first spacer around the first discourager, wherein, the second edge of the first discourager extends circumferentially past a first edge of the first spacer and a second edge of the first spacer is circumferentially aligned with the first edge of the first discourager;

enveloping a first body portion around the first spacer, wherein the second edge of the first discourager extends circumferentially past a first edge of the first body portion and a second edge of the first body portion extends circumferentially past the first edge of the first discourager;

forming a second inner shroud portion, wherein forming the second inner shroud portion comprises:

enveloping a second discourager around the fixture, the second discourager having a first edge and a second edge;

forming a second spacer around the second discourager, wherein the second edge of the second discourager extends circumferentially past a first edge of the second spacer and a second edge of the second spacer is circumferentially aligned with the first edge of the second discourager;

enveloping a second body portion around the second spacer, wherein the second edge of the second discourager extends circumferentially past a first edge of the second body portion and a second edge of the second body portion extends past the first edge of the second discourager; and operably coupling the first inner shroud portion and the second inner shroud portion, wherein the first inner shroud portion and the second inner shroud portion, when coupled, define a gap between a portion of the first discourager and a portion of the second body portion.

10. The method of claim 9, further comprising integrally coupling the first inner shroud portion to a first outer shroud portion and coupling the second inner shroud portion to a second outer shroud portion.

* * * * *